US008534950B2

(12) United States Patent
Sylvester

(10) Patent No.: US 8,534,950 B2
(45) Date of Patent: Sep. 17, 2013

(54) TOOTHBRUSH WITH INTEGRAL TOOTHPASTE DISPENSER AND TIMED MUSIC PLAY INTERVAL

(76) Inventor: Joy P. Sylvester, Newark, NJ (US)

( * ) Notice: Subject to any disclaimer, the term of this patent is extended or adjusted under 35 U.S.C. 154(b) by 453 days.

(21) Appl. No.: 12/807,746

(22) Filed: Sep. 13, 2010

(65) Prior Publication Data

US 2011/0103876 A1 May 5, 2011

Related U.S. Application Data

(63) Continuation-in-part of application No. 12/589,093, filed on Oct. 16, 2009, now Pat. No. 8,342,767.

(51) Int. Cl.
*A47L 13/22* (2006.01)

(52) U.S. Cl.
USPC ..... 401/277; 401/172; 401/173

(58) Field of Classification Search
USPC ..... 401/75–78, 152–156, 158–164, 171–174, 401/270, 277
See application file for complete search history.

(56) References Cited

U.S. PATENT DOCUMENTS

| | | | | | |
|---|---|---|---|---|---|
| 2,358,645 | A | | 9/1944 | Kiff | 401/276 |
| 2,562,937 | A | | 8/1951 | Moricich | 222/104 |
| 2,766,472 | A | | 10/1956 | Durrett | 401/281 |
| 2,908,924 | A | | 10/1959 | Turman | 401/173 |
| 3,549,268 | A | * | 12/1970 | Casselman | 401/154 |
| 3,738,761 | A | | 6/1973 | Segerstad | 401/173 |
| 3,995,648 | A | | 12/1976 | Kuryla | 401/173 |
| 4,013,370 | A | | 3/1977 | Gingras | 401/175 |
| 4,062,635 | A | | 12/1977 | Teh-Sheng | 401/175 |
| 4,199,270 | A | | 4/1980 | Tomasini | 401/183 |
| 4,277,194 | A | | 7/1981 | Smith | 401/173 |
| 4,375,924 | A | | 3/1983 | Lemire | 401/173 |
| 4,583,563 | A | * | 4/1986 | Turner | 132/311 |
| 4,744,124 | A | | 5/1988 | Wang et al. | 15/105 |
| 5,035,347 | A | * | 7/1991 | Trovo | 222/95 |
| 5,259,086 | A | | 11/1993 | Fong | 15/105 |
| 5,382,106 | A | * | 1/1995 | Voigt | 401/155 |
| 5,439,014 | A | | 8/1995 | Moussa | 132/311 |

(Continued)

OTHER PUBLICATIONS

"Twist & Paste Mashes-Up Toothbrush, toothpaste," found @ http://technabob.com/blog/2011/03/23/twist-brush-syringe-toothbrush/.

*Primary Examiner* — David Walczak
(74) *Attorney, Agent, or Firm* — Ernest D. Buff; Ernest D. Buff & Assoc. LLC; Margaret A. LaCroix

(57) ABSTRACT

A toothbrush with an integral toothpaste dispenser has a handle portion and a toothbrush portion. A commercially available toothpaste tube is opened at one end and contained within a central aperture of the handle of the integral toothbrush. Toothpaste from the toothbrush tube is discharged into a channel contained within the toothbrush portion and exits between the toothbrush bristles through a non-return valve positioned close to a bristle exit aperture. Toothpaste is squeezed by upward movement of a pedestal supporting the toothpaste tube when the user turns a knob on the bottom of the handle. The toothpaste tube is supported by a vertical support tube within the central aperture of the handle, producing an accordion-like, uniform, progressive toothpaste tube collapse. The non-return valve is only open during toothpaste delivery and thereby prevents toothpaste spills. The close proximity between the toothpaste exit aperture and the non-return valve enables the toothpaste to remain moist between brushings. Toothpaste residue between the non-return valve and the bristle exit aperture is readily rinsed away during cleaning to provide a hygienically clean toothbrush.

10 Claims, 9 Drawing Sheets

(56) References Cited * cited by examiner

U.S. PATENT DOCUMENTS

| | | | | |
|---|---|---|---|---|
| 5,755,523 | A | 5/1998 | Seydel | 401/176 |
| 6,851,882 | B1 | 2/2005 | Maloney | 401/183 |
| 7,774,888 | B2 | 8/2010 | Chen | 15/105 |

TOOTHBRUSH WITH INTEGRAL TOOTHPASTE DISPENSER AND TIMED MUSIC PLAY INTERVAL

This is a Continuation-In-Part of application Ser. No. 12/589,093, now U.S. Pat. No. 8,342,767, filed Oct. 16, 2009 for "Toothbrush with Integral toothpaste Dispenser and Associated Method," the disclosure of which is hereby incorporated in its entirety by reference thereto.

BACKGROUND OF THE INVENTION

1. Field of the Invention

The present invention relates to toothbrushes; and more particularly to a toothbrush which generates a musical selection when toothpaste resident within the handle is delivered to a brush head, the musical selection being long enough that brushing consumes a time period sufficient for proper dental care, and the brush head design enabling toothpaste to remain moist between brushings while the brush head is easily cleaned and remains hygienic after use.

2. Description of the Prior Art

Many patents address issues related to integral toothbrushes that have toothpaste provided therein. But these devices have complicated arrangements, including a toothpaste chamber tending to cause toothpaste to dry out. This, in turn, causes toothpaste clog, which is unhygienic and generates a foul odor and taste.

U.S. Pat. No. 2,358,645 to Kiff discloses a dental device. This dental device has a reservoir 10 that is tilted with an air vent 24 open to release a liquid dentifrice to the toothbrush. However, air gets into the reservoir slowly spoiling and drying the contents. This dental device does not deliver toothpaste to the brush.

U.S. Pat. No. 2,562,937 to Moricich discloses a tube collapsing mechanism for dispensers. A loop is present at one end of the tube, which is twisted by rotating a knob to progressively collapse the tube. There is no non-return valve in the flow path of the toothpaste or dentifrice, which can easily spill from the toothbrush bristles.

U.S. Pat. No. 2,766,472 to Durrett discloses a fountain toothbrush. A toothpaste tube is manually screwed into a tooth brush portion and is progressively squeezed as shown in FIG. 1 to direct the toothpaste into the bristles. However, the flow of toothpaste may be stopped by turning the nozzle 34 with respect to the recess 42. This is a manual operation and the user may forget to turn the nozzle with respect to the recess resulting in the spillage of the toothpaste over clothes and other important objects. There is no non-return valve in the flow path of the toothpaste within the toothbrush section. Besides toothpaste is always present within channels 26 and slowly dries out or becomes unhygienic.

U.S. Pat. No. 2,908,924 to Turman discloses a fountain toothbrush. The dentifrice is contained within the toothbrush. The device uses a piston and activating mechanism to drive the dentifrice into the toothpaste bristles. A valve located adjacent to the bristles is provided to stop the flow of the dentifrice when not needed, a manual operation. The valve is not a non-return valve and its closure is not automatic.

U.S. Pat. No. 3,738,761 to Segerstad discloses a reservoir brush for the application of agents to surfaces. The reservoir brush comprises a brush body that includes a shank with a through hole or duct. The enlarged end portion of the shank has external threads engaging with internal threads of a cylindrical receptacle for admission of viscous toothpaste. At its other end the shank is provided with a flat support surface having a first stud extending at right angles. The stud having a hole communicates with the duct of the shank. A second stud extends from one end of the support surface at right angles. A flat surface of the second stud faces the hollow stud. The flat support surface of the shank is adapted to receive a correspondingly shaped detachable brush element. This brush element has a through hole matching the hollow stud extending from the flat support surface. It also has an end surface adapted to engage the flat surface of the second stud. A resilient means is provided to keep the brush element in firm engagement with the support surface. The thread located at 4 has to be advanced to push the plunger 3 into the reservoir to expel the toothpaste through the aperture into a detachable toothbrush. There is no non-return valve in the toothpaste flow path. Consequently, the toothpaste and can spill if the toothbrush is tilted.

U.S. Pat. No. 4,013,370 to Gingras discloses a fountain tooth-brush. This tooth-brush carries its own supply of tooth paste in a removable cartridge inserted into the tooth-brush handle. The toothpaste is discharged through a passage from the cartridge to a flexible nipple located between the tooth-brush bristles. The toothpaste is propelled by a piston and is delivered to the bristles of the toothpaste through a flexible tube that is closed on one end with a slot allowing the toothpaste to escape only when the piston pressure is present and closes off when the piston pressure is off preventing the drying of the toothpaste. The toothpaste delivery tube interferes with the brushing action since it is at the same level as the bristles and the bristles deform during brushing.

U.S. Pat. No. 4,062,635 to Teh-Sheng discloses an automatic tooth-paste-supplying tooth brush. This toothbrush comprises bristles, guide tube means and a source container from which a viscous substance is forced through apertures disposed near the bristles. The flow of the viscous substance to the bristles is manually controlled by means of a knob disposed on the outside surface of a main shaft. An extension end of the container contains the toothbrush bristles, and may be configured as a toothbrush head. An opposite end of the toothbrush head includes a knob, which is disposed for advancing a follower member. The follower member serves to force the viscous substance to the opening of the aperture, permitting the viscous substance to surface to the bristles. At the forward end of the main shaft which contains the follower member, there is disposed a plug which permits closure of the open aperture, thereby avoiding danger of leakage of the viscous substance during non-usage periods. The brush is indicated to have a plurality of passages 3. The plug 4 merely closes one of the exit apertures 2. Toothpaste is dispensed by moving the plunger 9, but if the plug 4 closes the aperture, pressure builds up in the interior of the cavity 8. The amount of pressure depends on the efficiency of the plug. The operation of displacement of the plunger and opening of the plug 4 are not coordinated. Hence, delivery of toothpaste is not automatic, but is accomplished by two independent operations. The automatic toothpaste supplying brush does not use a commercial toothpaste package.

U.S. Pat. No. 4,199,270 to Tomasini discloses a dispenser-container brush for paste material. The dispenser-container brush for paste material comprises: (a) a stem or handle having a flexible wall, an internally hollow reservoir portion, an intermediate zone provided with means for the engagement of a bristle holder head member; and a substantially rigid elongated portion, said elongated portion having a dispensing opening for the paste material; (b) a substantially rigid bristle holder head member, having a bristle arrangement on an outer side or face and comprising an inner cavity of shape and size substantially corresponding to those of said elongated handle portion: a portion for engagement in said means on the intermediate handle portion, and a dispensing hole for the paste material in the face or side provided with said bristles, the position of said dispensing hole being such that the hole can be brought in register with said dispensing opening in the handle. The dispensing hole can be brought in register with the dispensing opening by a rotary movement or by a translational movement. The toothpaste is squeezed out by pressing the handle. The dispensing hole to the toothbrush exit aperture is merely lined up for delivery of toothpaste to the bristles or closed by being out of registry. There is no plunger or non-return valve in this device.

U.S. Pat. No. 4,375,924 to Lemire discloses a paste dispenser tooth-brush. This paste dispenser tooth-brush is convenient and simple to operate and is carried on a person. This paste dispenser tooth-brush comprises an intermediate tubular body, a tooth-brush head secured at one end of the intermediate body, a tooth-paste supply cartridge at the other end of the intermediate body, a cover fitting over the tooth-brush with a tooth-paste axial passage in the intermediate body, the latter forming a piston at one end screwing in the tooth-paste supply cartridge to expel the tooth-paste toward the toothbrush through the axial passage. An apertured cap at the open end of the cartridge is screwed and unscrewed by the piston to either expel the tooth-paste or to open the cartridge for refill. The toothpaste is delivered by screwing the reservoir inwards which pushes the toothpaste into aperture 2. The passage 2 is blocked by a slidable valve, which is normally in the closed position. Toothpaste is released by pressing button 9. There is a long distance between the valve and exit port of the toothbrush. Consequently, toothpaste in this region will dry and clog the passage. The opening and closing of the valve is not automatic as toothpaste is delivered to the brush.

U.S. Pat. No. 4,744,124 to Wang, et al. discloses a music tooth brush. The music tooth brush comprises a hollow brush hair stock, a touch switch containing the hollow part of said brush hair stock, a brush hair board floatingly mounted on the brush hair stock, and a hollow grip handle bar containing the music IC, batteries and sound-generating plate. When the user brushes his teeth with the tooth brush, the brush hair board can touch and press the touch switch in the brush hair stock to make the circuit in the grip handle bar become electrically conductive, so the sound-generating plate automatically generates the children's favorite music to eliminate their sense of ill feeling against brushing their teeth and further to foster in children a good habit of brushing their teeth after eating. The toothbrush plays music when the switch 2 is turned on and the bristles contact the teeth, completing the electrical circuit. There is no toothpaste contained within the brush and toothpaste is not delivered to the toothbrush bristles.

U.S. Pat. No. 5,259,086 to Fong discloses a musical toothbrush. This musical toothbrush has an elongate handle having proximal and distal ends. Bristles are formed at the distal end of the elongate handle and a music box is removably attached to the proximal end of the elongate handle. The music box has a housing within which a music generator is disposed such that it may conveniently be actuated by a child prior to brushing the teeth. A retainer disposed within the housing releasably retains the toothbrush upon the handle. The retainer has a tensioner assembly and a plurality of teeth disposed proximate the tensioner assembly such that the proximal end of the toothbrush is positionable intermediate the tensioner assembly and the teeth. The tensioner assembly urges the proximal end of the toothbrush handle toward the teeth such that the tips of the teeth are substantially depressed and therefore frictionally engaged to the proximal end of the toothbrush handle. Thus, the music box is removably attachable to the proximal end of the toothbrush handle such that the toothbrush may be utilized with or without the music box in place. The toothbrush plays music when the button 27 is turned on completing the electrical circuit. There is no toothpaste contained within the brush and toothpaste is not delivered to the toothbrush bristles.

U.S. Pat. No. 5,439,014 to Moussa discloses a toothbrush with toothpaste reservoir. This toothbrush is provided with a hollow interior cavity adapted to contain liquid dentifrice therein. The toothbrush includes a plurality of minute air apertures for equalizing the air pressure within the cavity and at least one dispensing hole in the bristle region of the toothbrush for dispensing the liquid dentifrice to the bristles. A threaded cap is provided at an open end of a handle of the toothbrush to prevent the dentifrice from escaping from the interior cavity. The cap can be removed to allow the refilling of the interior cavity with the liquid dentifrice. This device only delivers liquid dentifrice such as Paridex, Plax, and saline and does not deliver toothpaste. There are no mechanical delivery means or non-return valves within this device.

U.S. Pat. No. 5,755,523 to Seydel discloses a system and method for storing and dispensing toothpaste. This method of storing and applying toothpaste to a toothbrush includes steps of connecting a threaded male end of a tube of toothpaste to a female end of a storage receptacle, forcing toothpaste from the tube of toothpaste into the storage receptacle, disconnecting the tube of toothpaste from the storage receptacle, connecting a male end of a brush member to the female end of the storage receptacle, and forcing toothpaste out of the storage receptacle and into the brush member, whereby the toothbrush is made ready to brush a consumer's teeth. The user merely loads the toothpaste from a tube into the receptacle of the device and then screws the toothbrush in the place of the toothpaste tube and displaces a plunger to direct the toothpaste to the bristles of the toothbrush. This device does not accept a commercially available toothpaste within the device during brushing. There is no non-return valve in the toothpaste flow passage.

U.S. Pat. No. 6,851,882 to Maloney discloses a disposable toothbrush with a reservoir. This disposable toothbrush with reservoir can be used once or at most a handful of times and has a handle with a top surface and a bottom surface and a head attached thereto, the head having bristles thereon. A reservoir having toothpaste therein is disposed within the top surface of the handle and may extend through to the bottom while one or two covers secure the reservoir. The top cover can be removable in order to provide access to the toothpaste within the reservoir or the one or two covers act as bladders for feeding the toothpaste through a duct and an opening to the bristles or along a channel extending between the reservoir and the bristles. The toothbrush has a reservoir within which standard commercial toothpaste is inserted and squeezed. The toothbrush with the toothpaste tube within the container is discarded after use. There are no plungers or non-return valves provided in this device.

There remains a need in the art for an integrated toothbrush that carries a commercial toothpaste tube there within and delivers a user selected amount of toothpaste to the bristles of the toothbrush without further spillage. Also needed is toothbrush which generates a musical selection when toothpaste resident within the handle is delivered to a brush head. Further needed is a toothbrush wherein the brush head design enabling toothpaste to remain moist between brushings, and wherein the brush head is easily cleaned after use to restore its hygienic, odor-free state.

SUMMARY OF THE INVENTION

The toothbrush structure and method of use disclosed in the present application incorporates many of the principal elements disclosed by Parent application Ser. No. 12/589,093, filed Oct. 16, 2009. Specifically, the following elements are incorporated: (i) toothpaste is contained within the toothbrush handle; (ii) the toothpaste is delivered by turning a knob on the underside of the handle; and (iii) a non-return valve is positioned prior to the exit of the toothpaste between the bristles of the toothbrush.

Briefly stated, the invention involves an integral toothbrush device that contains a toothpaste tube placed in a support tube provided within a central aperture of the handle. The integral toothbrush device is assembled by screwing together two portions, the handle portion and the toothbrush portion. The integral toothbrush device uses a commercially available toothpaste tube. Toothpaste is delivered between bristles of the toothbrush through a channel when the user raises a pedestal by turning a knob provided in the underside of the handle. The toothpaste flow channel has a non-return valve adjacent to the toothpaste exit location within the toothbrush bristles. Since toothpaste is contained within the toothpaste tube and the toothpaste tube is held within a support tube, the upward movement of the pedestal results in uniform collapse of the toothpaste tube resulting in smooth delivery of the toothpaste to the toothpaste flow channel.

A commercially available toothpaste tube is opened and screwed into an aperture provided within a cap member. The toothpaste tube is inserted within the support tube contained within a hollow central aperture of the handle. The cap member rests on the support tube. The support tube has an O-ring seal against the cylindrical wall of central aperture of the handle, preventing passage of the toothpaste into the central aperture of the handle. The toothpaste is supported by a pedestal that is within the support tube. Two laterally extending posts pass through two vertical slots provided on either side of the support tube and engage with interior screw threads of the hollow central aperture of the handle. When the user turns a knob connected to the support tube in a clockwise direction, the pedestal raises, squeezing the toothpaste tube. Toothpaste is delivered from the open end of the toothpaste tube and carried through a channel through a non-return valve that is adjacent to the exit location to the toothbrush bristles. The user determines the amount of toothpaste to be delivered to the bristles and during toothpaste delivery, the non-return valve is open and shuts off once the turning action of the knob is stopped automatically. Turning of the knob is accomplished either manually or by a motorized drive. The embodiment of the motorized version has a timing circuit that plays music through a speaker in the handle of the integral toothbrush while brushing and encourages brushing for a recommended period encouraging clean teeth and healthy gums. The non-return valve prevents toothpaste contained within the handle from drying out or interacting with ambient air. The amount of toothpaste remaining in the space between the non-return valve and the exit of the toothpaste between the bristles of the toothbrush is small. As such, it is readily cleared when the toothbrush is rinsed after brushing, thereby maintaining a clean hygienic toothbrush environment. Significant advantages are realized by practice of the present invention. The key elements of the toothbrush with integral toothpaste dispenser of the present invention comprise, in combination, the features set forth below:

1) an integral toothbrush configured in two parts, comprising a hollow handle and a hollow replaceable brush portion;

2) said hollow handle portion having a threaded interior cylindrical aperture with an open end on the top and an open end at the bottom;

3) said bottom end of said handle portion receiving a turning knob attached to a vertical support tube with two lateral slots that engage with two posts of a pedestal;

4) said pedestal having two posts that pass through said two lateral slots of said vertical support tube and engage with said interior cylindrical aperture threads of said handle, whereby when the knob is turned, the pedestal moves upwardly for clockwise rotation and downwards for counterclockwise rotation;

5) a cap of a commercially available toothpaste tube is removed and a toothpaste exit end is screwed into a threaded aperture of an end cap member that fits tightly on the distal end of said vertical support tube;

6) said end cap member having an O-ring seal provided on its lateral cylindrical portion that engages with an open top end of the threaded hollow handle aperture;

7) said toothpaste being delivered into a channel within a hollow interior of the toothbrush portion when the knob is turned in a clockwise direction to move the pedestal upwardly and thereby squeeze and progressively collapse the commercial toothpaste tube;

8) said toothpaste passing through said channel and being delivered between the bristles of the toothbrush through an aperture that is in close proximity with the non-return valve;

whereby the user determines how much toothpaste is delivered at the toothbrush bristles by turning the knob either manually or by electrical motor drive, the non-return valve automatically closes upon completion of toothpaste delivery and prevents drying out or spill of the toothpaste from the integral toothpaste dispenser, and the small space between toothpaste exit aperture to the brush bristles and the non-return valve ensures removal of toothpaste in the small space during rinsing, thereby providing a hygienically clean toothbrush.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

This invention relates to a toothbrush with integral toothpaste dispenser. This allows the user to use and carry the integral toothbrush without the need to carry a separate toothpaste tube and without having to worry about spillage of toothpaste on clothing and other valuable articles.

Briefly stated, the invention involves an integral toothbrush device that contains toothpaste within a support tube placed in the central threaded aperture of a handle wherein the toothpaste is delivered between the bristles of the toothbrush when a knob on the underside of the toothbrush handle is turned either manually or by a motorized drive. The integral toothbrush device is made in two parts wherein the toothbrush portion is screwed into a handle portion. In this manner, a worn toothbrush may be removed and a fresh new toothbrush may be installed. A commercially available toothpaste tube is screwed into a cap member and can be replaced by the user when the toothpaste tube is exhausted. The toothpaste is prevented from entry back into the handle by a seal mechanism provided on the cylindrical surface of the cap member that seals against the central threaded aperture of the handle, preventing flow of toothpaste into the handle central aperture. Prior to exiting the exit of the toothpaste between the bristles of the toothbrush, the delivered toothpaste goes through a non-return valve and thus the toothpaste contained within the handle is prevented from drying out or interacting with ambient air. The amount of toothpaste remaining in the space between the non-return valve and the exit of the toothpaste between the bristles of the toothbrush is small due to the small distance between the non-return valve and the exit aperture between the bristles. It is easily cleared when the toothbrush is rinsed after brushing, thereby maintaining a clean hygienic toothbrush environment.

More specifically, the integral toothbrush device uses a commercially available toothpaste tube within the handle of the device. A commercially available toothpaste tube is squeezed by an upwardly moving pedestal, delivering the toothpaste into the hollow interior and channel of the hollow replaceable brush portion. The passage of the toothpaste within the hollow replaceable brush portion includes a non-return check valve, which is adjacent to the exit port that delivers the toothpaste to the bristles of the hollow replaceable brush portion. The toothpaste tube is squeezed by the pedestal. This, in turn, leads to uniform progressive collapse of the toothpaste tube, since the toothpaste is first contained within the toothpaste tube and the toothpaste tube is contained within the vertical support tube.

Figure 1:
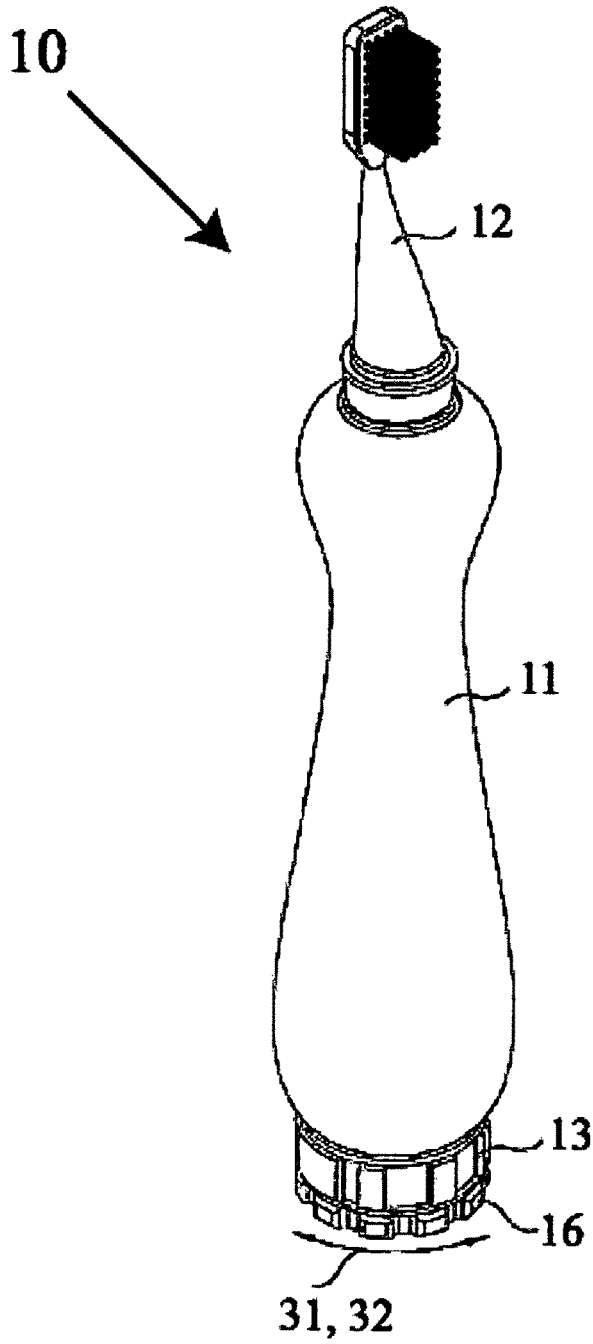
FIG. 1 illustrates a sketch of the integral toothbrush device according to the present invention.

FIG. 1 illustrates generally at 10 a sketch of the integral toothbrush device according to the present invention. The handle portion is shown at 11 and the toothbrush portion is shown at 12. An end cap 13 is used to screw in and retain the turning knob on the bottom end of the handle. The counterclockwise direction of rotation, 31, of the knob lowers a pedestal contained within the hollow handle 11 and a clockwise direction rotation. 32 raises the pedestal, squeezing the toothpaste and feeding toothpaste into the hollow interior of toothbrush portion 12 and through the channel leading to the toothbrush bristle. The size of the hollow portion depicted has been enlarged for clarity and may be much smaller, since it represents the reservoir of the toothpaste within the toothbrush portion 12.

Figure 2:
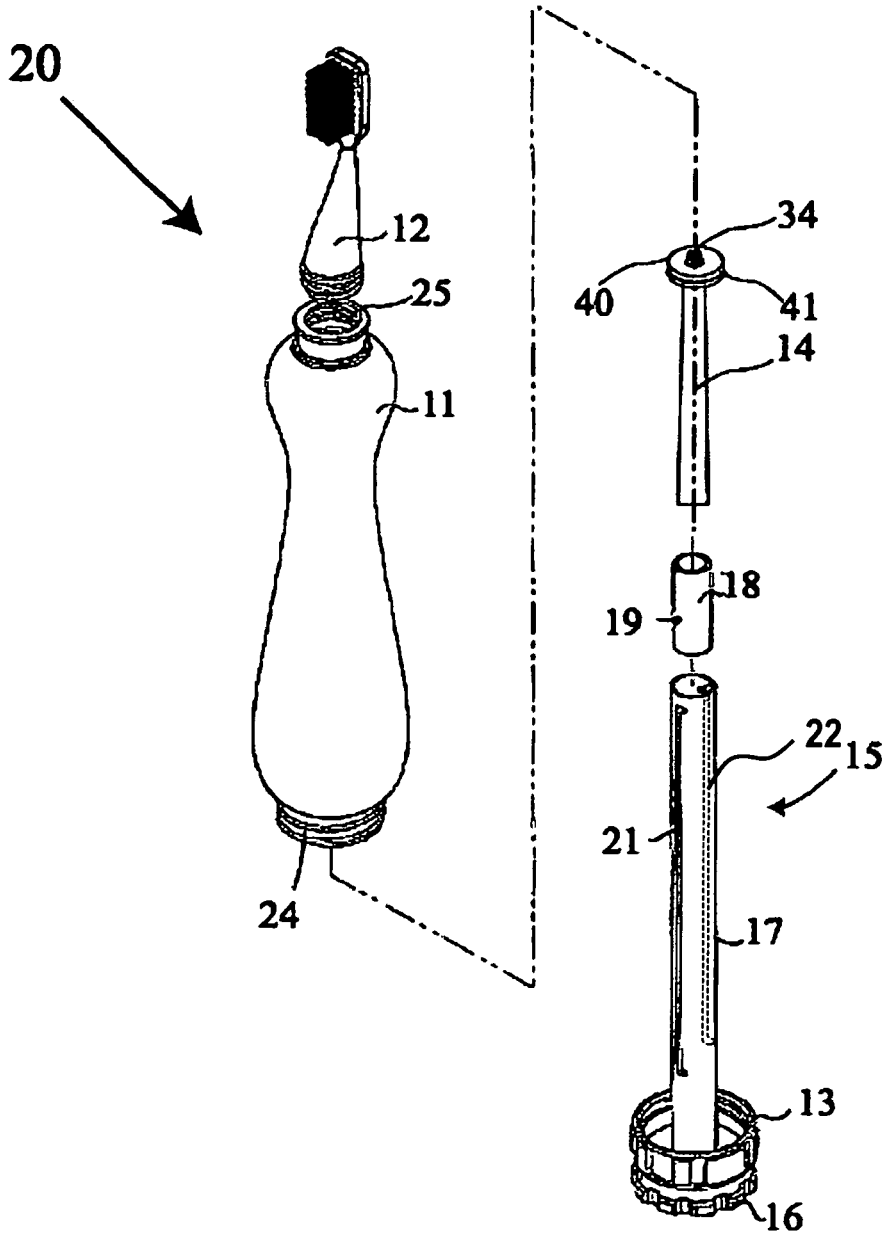
FIG. 2 shows the details of the interior of the integral toothbrush device.

FIG. 2 shows the details of the interior of the integral toothbrush device. The hollow toothbrush portion is screwed into the top upper threaded aperture of the handle 11. The bottom aperture of the handle 11 has external threads that receive the end cap 13. A vertical slotted support tube is attached to the knob 16. Within this tube a pedestal 18 inserted first and two diametrically opposed posts 19 and 20 (post 20 is invisible in this view) are inserted. These two posts pass through slots 21 and 22 and extend further engaging with threads present within the hollow interior wall of the handle (not shown in this view). Thus, turning the knob 16 raises the pedestal upwards. Commercial toothpaste tube 14 is inserted into the tube 17 after removing the cap of the toothpaste. The open end 34 of the toothpaste is screwed into an end cap member 40, which engages with the top end 25 of the handle 11, as the toothpaste tube is inserted into the tube 17. The end cap member 40 has sealing means such as an o-ring on its cylindrical periphery, which engages with the cylindrical portion at the top end of the handle 11 above the threaded portion. Thus, when the pedestal is raised to squeeze the toothpaste tube, toothpaste is delivered through the open end of the toothpaste tube 34, filling the hollow interior of the toothbrush portion 12. The seal 41 prevents the entry of the toothpaste into the interior of the handle.

Figure 3A:
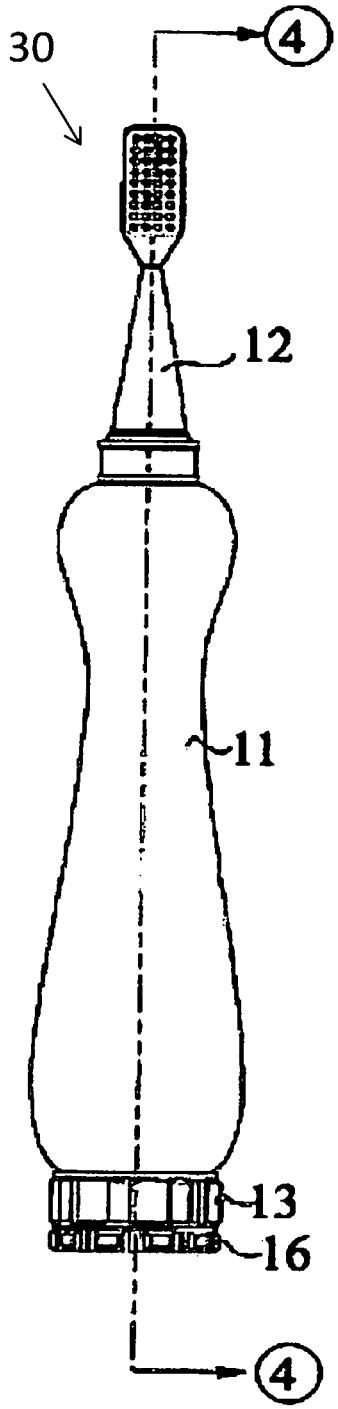
FIGS. 3A and 3B illustrate in two views, FIG. 3*a* and cross section FIG. 3*b*, the assembled integral toothbrush device.
Figure 3B:
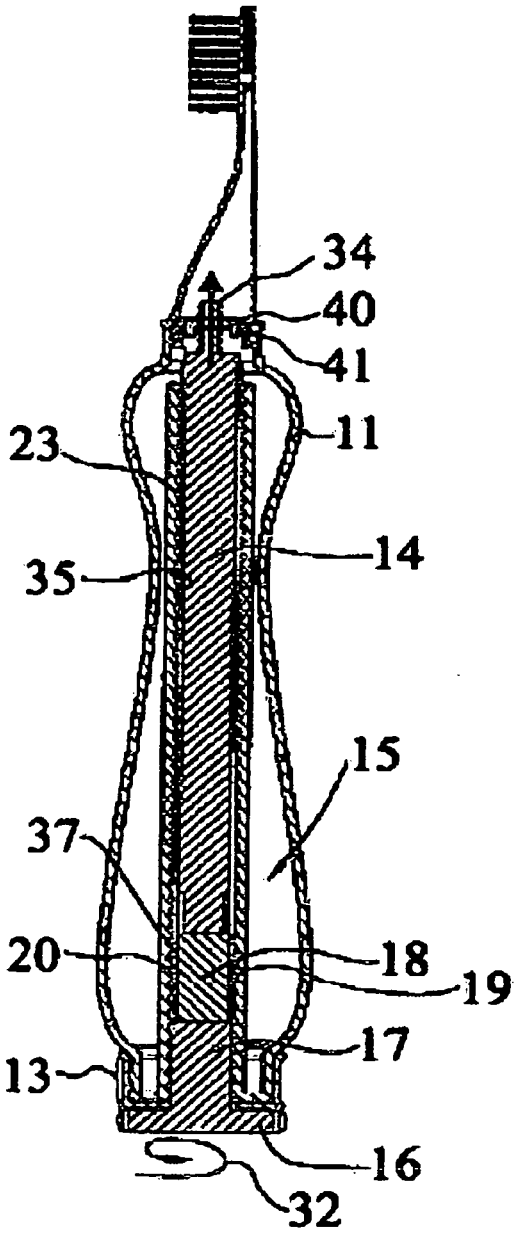

FIG. 3 illustrates in two views, FIG. 3*a* and FIG. 3*b*, the assembled integral toothbrush device. FIG. 3*b* is a cross section taken along 4-4 of FIG. 3*a*. The handle 11 has threaded axial bore 23 with threads 37. These threads engage with protruding posts 19 and 20 from the pedestal 18 that are within the pedestal plunger assembly. When the knob 16 at the bottom portion of the handle is turned clockwise along direction 32, the pedestal 18 is raised, extruding toothpaste from the open end of the toothpaste tube 14 at opening 34 along the arrow shown. The end cap member 40 and seal element 41 prevent ingress of the toothpaste into the interior of the handle 11.

Figure 4:
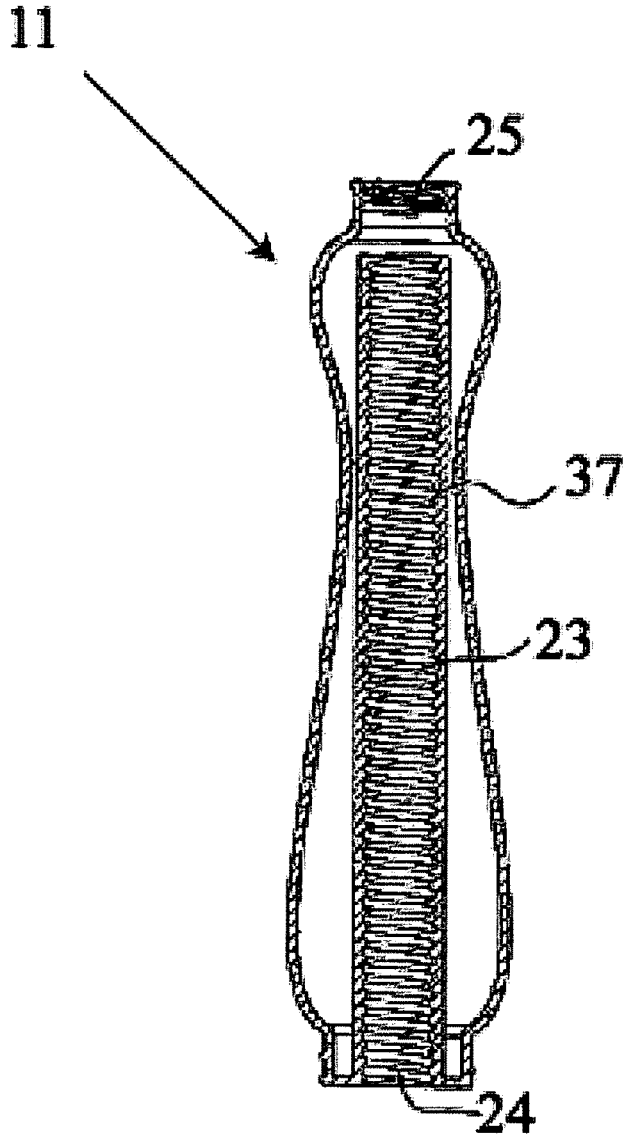
FIG. 4 shows the cross section of the handle showing the central interior bore with threads.

FIG. 4 depicts a cross section of the handle 11 showing the central interior bore 23 with threads 37. Screw threads are present in the interior at the top end 25 to engage with threads of toothbrush portion 12. The threads 37 extend through the bottom of the handle at 24 so that the posts 19 and 20 may be set to engage with the threads. The bottom end 24 has external threads to engage with end cap 13.

Figure 5:
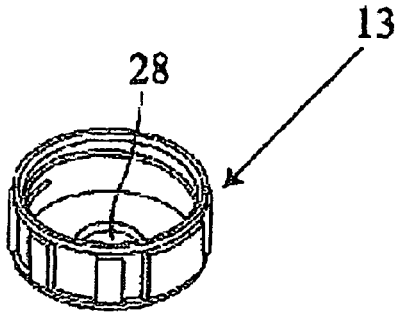
FIG. 5 illustrates the details of the end cap.

FIG. 5 illustrates the details of the end cap 13. As shown, end cap 13 has a central aperture through which the vertical tube 17 passes. The interior threads of 13 engage with external threads at the bottom end 24 of post 11.

Figure 6:
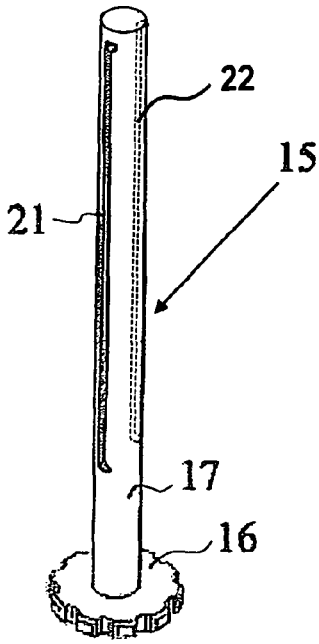
FIG. 6 illustrates the plunger assembly and details of the vertical slotted support tube.

FIG. 6 illustrates the plunger assembly 15 with details of the vertical slotted support tube 17. The vertical tube 17 has two slots 21 and 22. The overall length of these slots determines how much the toothpaste will be squeezed during use. The knob 16 is permanently attached to the vertical tube 17.

Figure 7:
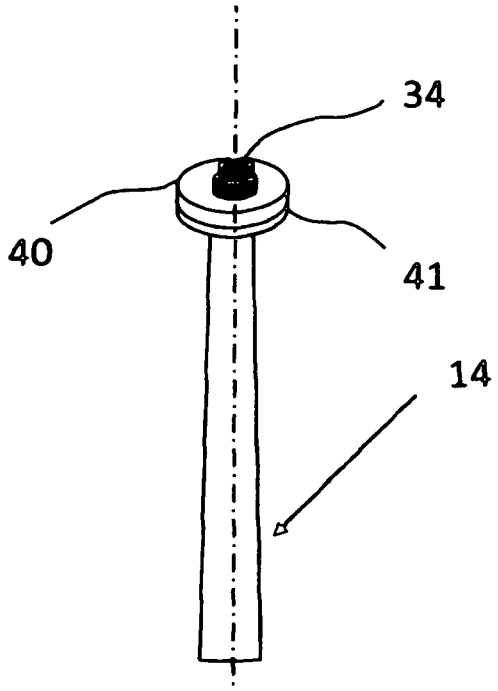
FIG. 7 illustrates the details of the attachment of the commercial toothpaste tube to the end cap member with a central threaded aperture.

FIG. 7 illustrates the details of the attachment of the commercial toothpaste tube 14 to the end cap member 40 with a central threaded aperture. The cap of the toothpaste is removed first and is screwed into the threaded aperture of the end cap member 40. End cap member 40 has a central aperture that fits over the upper end of the vertical slotted tube 17 and carries an O-ring 41 on the external cylindrical surface to provide sealing action, thereby preventing ingress of squeezed toothpaste into the interior of the handle 11.

Figure 8:
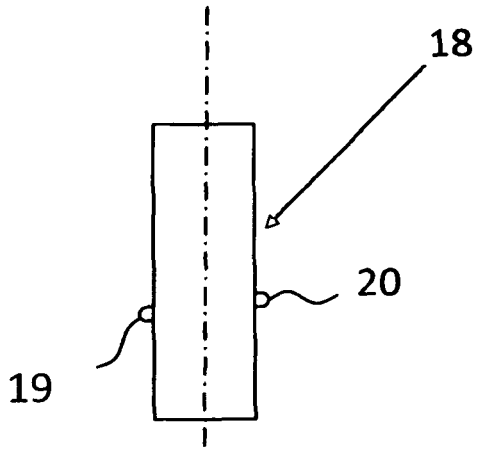
FIG. 8 illustrates the details of the pedestal.

FIG. 8 illustrates the details of the pedestal 18. The pedestal may be a solid object or a tube, but its top end that contacts the toothpaste tube is sealed so as to push against the toothpaste tube when the pedestal is raised. As illustrated, pedestal 18 has two protruding posts 19 and 20. Since these posts must be collapsed to place the pedestal within the vertical slotted tube 17, they may be spring-loaded posts. On the other hand they may be screwed in after inserting the pedestal, passing the posts through the slots 21 and 22 of vertical slotted tube 17.

Figure 9:
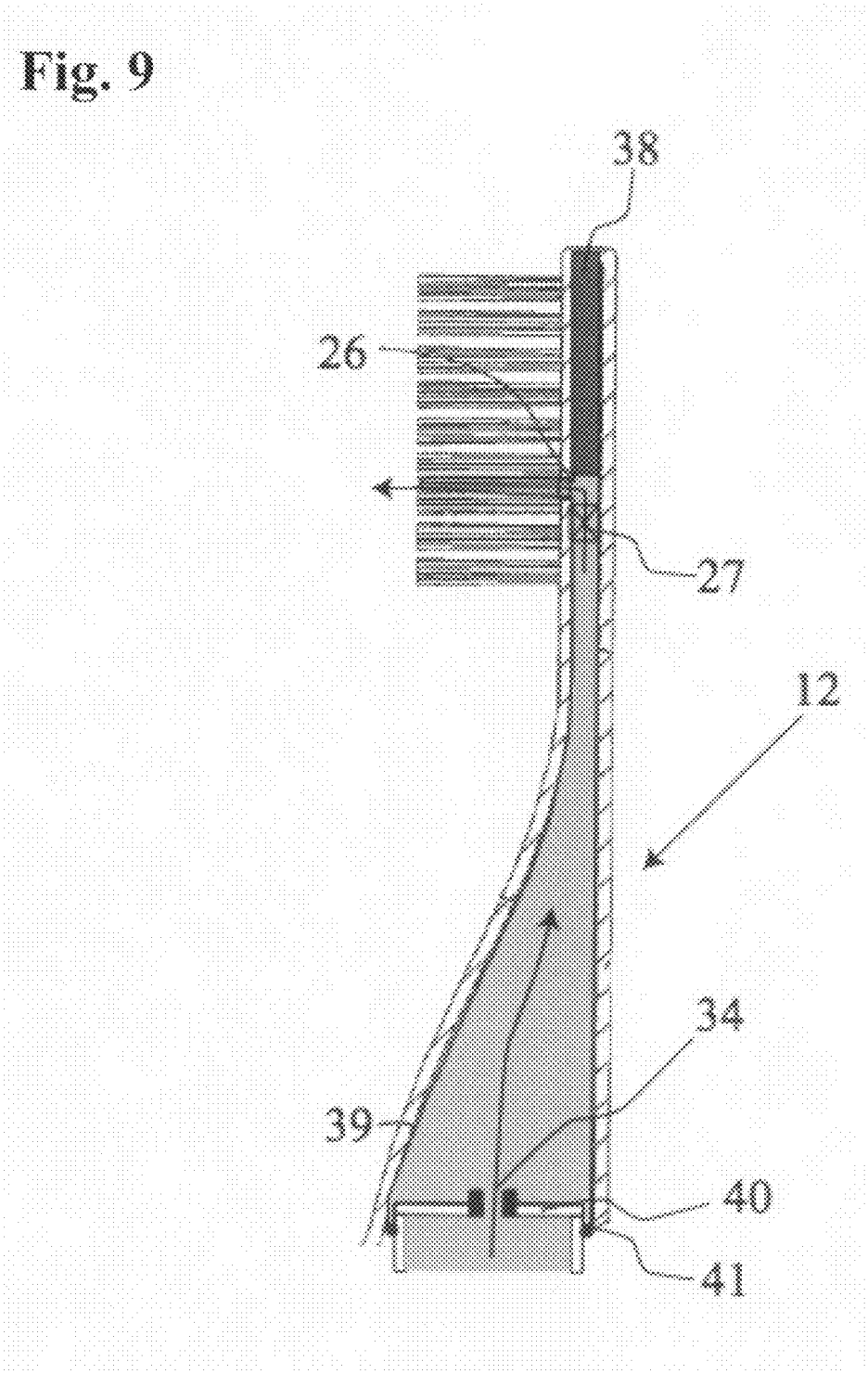
FIG. 9 illustrates the details of the toothbrush portion as toothpaste is filled into the interior cavity.

FIG. 9 illustrates the details of the toothbrush portion 12 as toothpaste is filled in within the interior cavity 39. The toothpaste enters the cavity from the open end 34 of the toothpaste tube 14 as shown. The toothpaste passes through a non-return valve 27 and then into an opening 26, which releases the toothpaste to the bristles of the brush, as shown by the arrow.

When the toothpaste is no longer pushed by the upward movement of the pedestal 18, the non-return valve is closed and no toothpaste can now spill. The small volume of toothpaste entrapped in the portion between the non-return valve and the opening 26 is easily dissolved and removed when the toothbrush is cleaned or rinsed after brushing. The plug 38, which may be a slide-fit plug or screwed-in plug may be removed to clean the interior passages of the toothbrush portion.

Figure 10A:
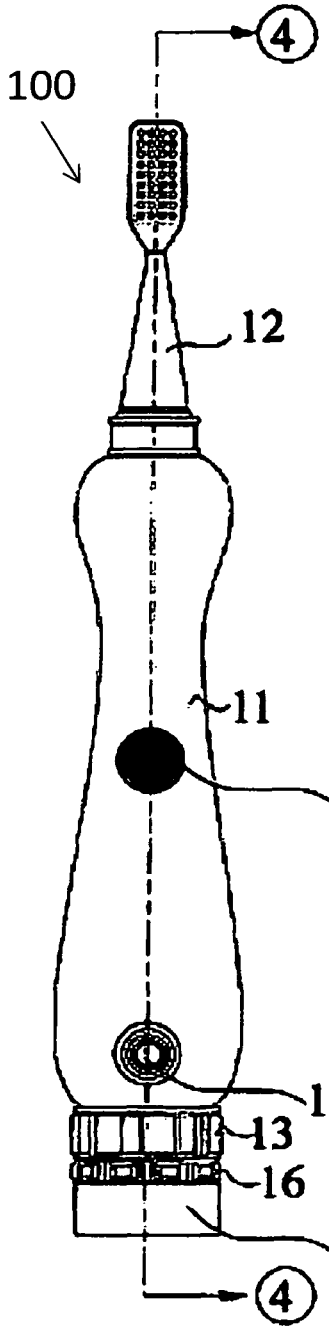
FIGS. 10A and 10B illustrate at 100 two views FIG. 10*a* and FIG. 10*b* of an alternate embodiment of the invention wherein the knob is turned by an electric motor drive.
Figure 10B:
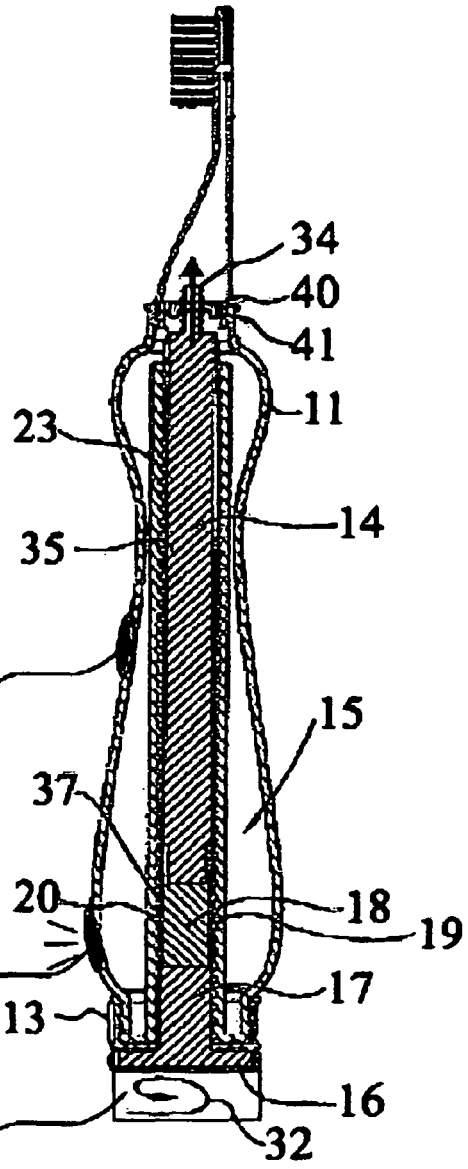

FIGS. 10*a* and 10*b*, shown generally at 100, illustrate two views of an alternate embodiment of the invention wherein the knob is turned by an electric motor drive 101. FIG. 10*b* is a cross section taken along 4-4 of FIG. 10*a*. The electric motor is activated by pushing the button 102 and holding until toothpaste is observed within the tooth brush bristles. At this point, the button 102 is released. The pressing action of the button activates a timer circuit which, in turn, activates an audio circuit that plays music using speaker 103 during a preselected period of time. This time period is typically about 30 seconds to 5 minutes, preferably about 1 to 3 minutes and most preferably about 1.5 to 2.5 minutes. The length of the preselected time period is especially tailored to promote a brushing period that massages the teeth and gums, and promotes a healthy, hygienic oral cavity. The user brushes for the duration of the musical selection which, as noted, plays for the preselected time period. In this manner, the user receives guidance as to the brushing time recommended for optimal dental health.

Figure 11:
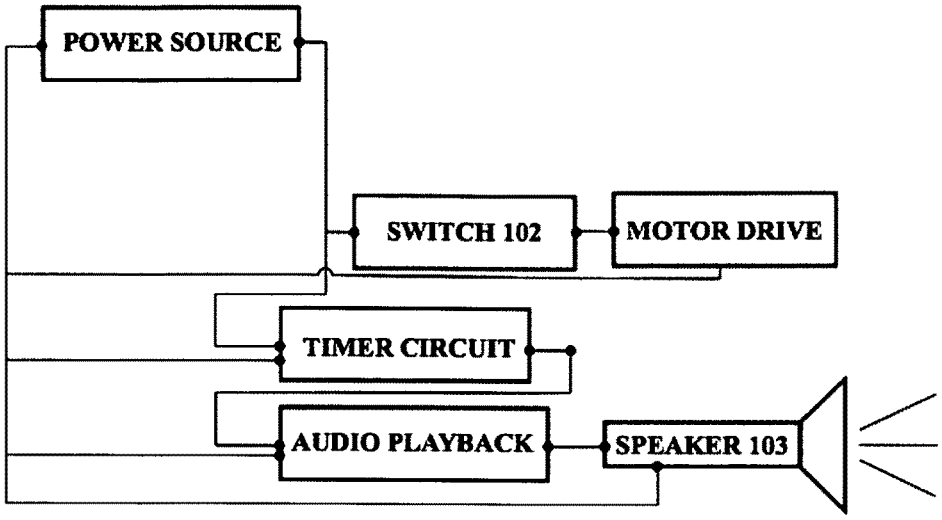
FIG. 11 shows a schematic diagram of the electronic circuit for driving the second embodiment of the invention.

FIG. 11 shows a schematic diagram of the electronic circuit for driving the second embodiment of the invention. The power supply has two wires which, when connected, energize any portion of the circuit. The power supply hot leg passes through the switch, which turns on the electric timer circuit supplying power to the electric motor as long as the button 102 is pressed. Pressing the button also starts the timer circuit, which turns on the audio playback circuit and energizes the speaker.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A toothbrush with integral toothpaste dispenser, comprising:

a) a hollow handle portion and hollow replaceable brush portion having bristles held together by a screw threaded attachment;

b) said hollow handle portion having a threaded bore with an open end at the top and an open end at the bottom;

c) said bottom end of said handle portion receiving a turning knob attached to a vertical support tube with two lateral slots that engage with two posts of a pedestal;

d) said posts of said pedestal pass through said two lateral slots of said vertical support tube and engage with said threaded bore of said handle, whereby when the knob is turned, the pedestal moves upwardly for clockwise rotation and downwards for counterclockwise rotation;

e) a toothpaste tube containing toothpaste having a toothpaste exit cap removed and screwed into a threaded aperture of an end cap member that fits tightly on a distal end of said vertical support tube;

f) said end cap member having an O-ring seal provided on a lateral cylindrical portion that engages with an open top end of the hollow handle;

g) said toothpaste being delivered into a channel within said hollow interior of said toothbrush portion when the knob is turned in a clockwise direction to move the pedestal upwardly and thereby squeeze and progressively collapse said toothpaste tube;

h) said toothpaste passing through said channel and being delivered between the bristles of the toothbrush portion through an aperture that is in close proximity with a non-return valve, and thereby creates a small space between a exit aperture and the non-return valve; and whereby the user determines how much toothpaste is delivered at the toothbrush bristles by turning the knob either manually or by electrical motor drive, the non-return valve automatically closes upon completion of toothpaste delivery and prevents drying out or spill of the toothpaste from the integral toothpaste dispenser, and the small space between toothpaste exit aperture to the brush bristles and the non-return valve ensures removal of toothpaste during rinsing, thereby providing a hygienically clean toothbrush.

2. The toothbrush with integral toothpaste dispenser as recited by claim 1, wherein said pedestal is solid.

3. The toothbrush with integral toothpaste dispenser as recited by claim 1, wherein said pedestal is a tube with its top end closed thereby pushing against the toothpaste tube.

4. The toothbrush with integral toothpaste dispenser as recited by claim 1, wherein said toothpaste tube collapses uniformly and progressively due to the vertical support tube and the toothpaste tube supported by an incompressible property of toothpaste contained therein when the pedestal squeezes the toothpaste tube resulting in accordion like toothpaste tube collapse.

5. The toothbrush with integral toothpaste dispenser as recited by claim 1, wherein said rotation of the knob is done by said electric motor drive turned on by pressing and holding a button on the handle until sufficient amount of toothpaste emerges between the bristles of the toothbrush as desired by the user.

6. The toothbrush with integral toothpaste dispenser as recited by claim 5, wherein pressing the button on the handle activates a timing circuit that powers a speaker provided in the handle, playing music for a brushing time period encouraging brush periods suited for optimal teeth cleaning and gum health.

7. The toothbrush with integral toothpaste dispenser as recited by claim 6, wherein the brushing and music playing period is adjusted by changing the timing circuit properties.

8. The toothbrush with integral toothpaste dispenser as recited by claim 7, wherein the brushing time is a preselected time period ranging from about 30 seconds to 5 minutes.

9. The toothbrush with integral toothpaste dispenser as recited by claim 8 wherein the brushing time is a preselected time period ranging from about 1 to 3 minutes.

10. The toothbrush with integral toothpaste dispenser as recited by claim 9, wherein the brushing time is a preselected time period ranging from about 1.5 to 2.5 minutes.

* * * * *